US008808116B2

(12) United States Patent
Dodson

(10) Patent No.: US 8,808,116 B2
(45) **Date of Patent: *Aug. 19, 2014**

(54) TENNIS SERVE TRAINING DEVICES, SYSTEMS AND METHODS

(76) Inventor: Lisa Dodson, Oakland, CA (US)

( * ) Notice: Subject to any disclaimer, the term of this patent is extended or adjusted under 35 U.S.C. 154(b) by 439 days.

This patent is subject to a terminal disclaimer.

(21) Appl. No.: 13/136,647

(22) Filed: Aug. 5, 2011

(65) Prior Publication Data

US 2013/0035180 A1 Feb. 7, 2013

(51) Int. Cl.

| | |
|---|---|
| ***A63B 69/38*** | (2006.01) |
| ***A63B 15/00*** | (2006.01) |
| ***A63B 59/00*** | (2006.01) |
| *A63B 71/06* | (2006.01) |
| *A63B 69/36* | (2006.01) |
| *A63B 63/08* | (2006.01) |

(52) U.S. Cl.

CPC ..... *A63B 69/385* (2013.01); *A63B 2071/0694* (2013.01); *A63B 15/005* (2013.01); *A63B 2225/093* (2013.01); *A63B 59/0025* (2013.01); *A63B 2225/09* (2013.01); *A63B 69/3667* (2013.01); *A63B 2210/50* (2013.01); *A63B 63/08* (2013.01)

USPC ..... 473/459; 473/461; 473/463

(58) Field of Classification Search

USPC ..... 473/459, 461, 463, 464, 422–425, 549, 473/551

See application file for complete search history.

(56) References Cited

U.S. PATENT DOCUMENTS

| | | | | |
|---|---|---|---|---|
| 4,023,798 | A * | 5/1977 | Pronin | 473/462 |
| 5,011,143 | A * | 4/1991 | Jones | 473/459 |
| 6,648,780 | B1 * | 11/2003 | Boldin | 473/461 |
| 8,100,783 | B2 * | 1/2012 | Dodson | 473/459 |
| 2005/0143201 | A1 * | 6/2005 | House | 473/459 |
| 2011/0275460 | A1 * | 11/2011 | Dodson | 473/463 |
| 2013/0035180 | A1 * | 2/2013 | Dodson | 473/463 |
| 2013/0157785 | A1 * | 6/2013 | Connors | 473/429 |

* cited by examiner

*Primary Examiner* — Raleigh W Chiu
(74) *Attorney, Agent, or Firm* — Francis Law Group

(57) ABSTRACT

A tennis skill training device comprising a substantially planar foot placement platform platform having foot placement graphics disposed thereon, the foot placement graphics consisting of a first stance position representing right and left foot positions for a right-handed player proximate a first court position, a second stance position representing right and left foot positions for a right-handed player proximate a second court position, and a first toss target representing a first forward foot post-stroke position for the right-handed player. In some embodiments, the graphics include a third stance position representing right and left foot positions for a left-handed player proximate the first court position, a fourth stance position representing right and left foot positions for the left-handed player proximate the second court position, and a second toss target representing a first forward foot post-stroke position for the left-handed player.

5 Claims, 10 Drawing Sheets

TENNIS SERVE TRAINING DEVICES, SYSTEMS AND METHODS

FIELD OF THE PRESENT INVENTION

The present invention relates generally to tennis training devices and methods. More particularly, the invention relates to tennis devices and methods for training a user to properly serve a tennis ball to commence a game of tennis.

BACKGROUND OF THE INVENTION

As is well known in the art, a tennis serve is the stroke that placed the ball in play in a game of tennis. It is often deemed the most important stroke in the game.

As is also well known in the art, a tennis serve is a complicated action that is composed of static and active phases, and inter-related motions therebetween. The object or goal of the serve phases is to hit a tennis ball at a desired position and in a timely manner, whereby the ball is directed to a desired point on the tennis court with the desired rotation or spin.

The static phase of the serve comprises positioning the body on the court prior to the service stroke. During a flat or basic serve, a player typically initially positions him/her self behind the baseline about two to three feet to the right or left of the center mark or line. The player is also positioned sideways to the net with the left foot (of a right-handed player) positioned two to three inches behind the line and their toes pointed toward the net post. The back foot is positioned parallel to the baseline and spread conformably from the front foot.

As discussed in detail herein, foot placement and movement (during the active phase, discussed below) are key aspects of an effective and consistent serve and are typically varied depending on the type of tennis serve being performed, e.g., topspin, slice, etc.

The active phase of a tennis serve includes two critical actions: the ball toss and stroke (or service swing). Similar to foot placement, the ball toss is often varied depending on the type of serve being performed. For example, when a flat or basic serve is desired, a player typically tosses the tennis ball in front, slightly to the right of the leading shoulder, and at least slightly higher than the player can reach with their racquet, whereby the ball can be hit effectively during its downward trajectory.

When a slice serve is desired, the ball is typically tossed in front, and slightly closer and further to the right of the leading shoulder than the flat serve toss, and at least slightly higher than the player can reach with their racquet. When a kick serve is desired, the ball is typically tossed in a backwards arcing motion (from front to landing behind the heel of the back foot) so that the player strikes the ball when it is crossing over the tossing arm shoulder, and, again, at least slightly higher than the player can reach with their racquet.

The stroke (or service swing) is also a key aspect of an effective tennis serve. As set forth in Applicant's Co-pending application Ser. No. 12/731,987, which is incorporated by reference herein, the single most important aspect of service mechanics is that the service or hitting arm is fully extended upward during the striking motion. Although one might think this would be a relatively simple matter to master, most novice (and quite a few intermediate) tennis players find this to be quite difficult.

One way that some players force themselves to reach for the ball at the apex of its toss trajectory is by maintain a straight service arm straight throughout the swing. This "windmill" type of serve places a considerable amount of strain on a player's shoulder and can, and often times will, cause shoulder damage.

Proper service mechanics thus comprises bending the service arm at the elbow at the initial stroke position and extending or throwing the lower half of the service arm upward from the bent arm position. With a loose wrist, this causes all of the energy emanating from a player's legs, torso and arm to be translated to the racquet, whipping the racquet upward and forward at the ball. The whipping action generates far greater racquet and, thereby, ball speeds.

Conversely, if a player performs a service stroke with a straight arm, the racquet speed is dependent upon and, hence, limited by how fast the player can rotate their service arm around their shoulder joint.

Despite a plethora of commercially available tennis training devices, there is neither a commercially available tennis training device that is designed and adapted to develop proper foot placement, nor a training system that is designed and adapted to develop proper foot placement and stroke mechanics for performing an effective tennis serve.

It is thus an object of the present invention to provide a tennis training device that is designed and adapted to develop proper foot placement for performing an effective tennis serve.

It is another object of the present invention to provide a tennis training device that is designed and adapted to develop proper foot placement for performing an effective tennis serve and for enhancing the stability of a user's feet during a service stroke.

It is another object of the present invention to provide a tennis training system to develop proper foot placement and stroke mechanics for performing an effective tennis serve.

It is another object of the present invention to provide a tennis training system to develop proper foot placement, ball toss trajectory and stroke mechanics for performing an effective tennis serve.

These and further objects will be more readily apparent when considering the following disclosure.

SUMMARY OF THE INVENTION

The present invention is directed to tennis training devices, systems and methods for developing proper foot placement, ball toss trajectory and stroke mechanics for performing an effective tennis serve. In accordance with one embodiment of the invention, there is thus provided a foot placement platform for developing proper foot placement and movement during a serve.

In one embodiment of the invention, the platform comprises a substantially planar member having a top and bottom surface, the top surface of the platform including foot placement graphics disposed thereon, the foot placement graphics consisting of a first stance position representing right and left foot positions for a right-handed player proximate a first court area (or position), a second stance position representing right and left foot positions for a right-handed player proximate a second court area, and at least a first toss target representing a forward foot post-stroke position for the right-handed player.

In some embodiments of the invention, the graphics include a third stance position representing right and left foot positions for a left-handed player proximate the first court position, a fourth stance position representing right and left foot positions for the left-handed player proximate the second court area, and a second toss target representing a forward foot post-stroke position for the left-handed player.

In some embodiments of the invention, the graphics include third and fourth toss targets representing forward foot post-stroke positions for a right-handed player performing a slice and flat serve, and fifth and sixth toss targets representing forward foot post-stroke positions for a left-handed player performing a slice and flat serve.

In some embodiment, the platform includes an anti-skid backing disposed on the bottom surface.

In some embodiments, the platform is constructed of a compliant material selected from the group consisting of closed cell EVA, polyethylene and polyurethane foams.

In accordance with another embodiment of the invention, there is provided a tennis training system comprising the foot placement platform described above and a tennis stroke device. The tennis stroke device having a grip emulating a tennis racquet grip sized to be held by a user, a single flexible umbilical having first and second ends, the first end being attached to and emanating from the distal end of the grip, and a weight attached to the second end of the umbilical.

In accordance with another embodiment of the invention, there is also provided a tennis training system comprising the foot placement and stroke devices described above and a ball toss training device. The ball toss device includes a base, adjustable vertical and horizontal supports, and a target hoop.

As will readily be appreciated by one having ordinary skill in the art, the tennis serve training system of the invention, when properly employed, provides an effective means for developing the key aspects of a serve—foot placement, ball toss or trajectory and service stroke—separately or jointly.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Figure 1:
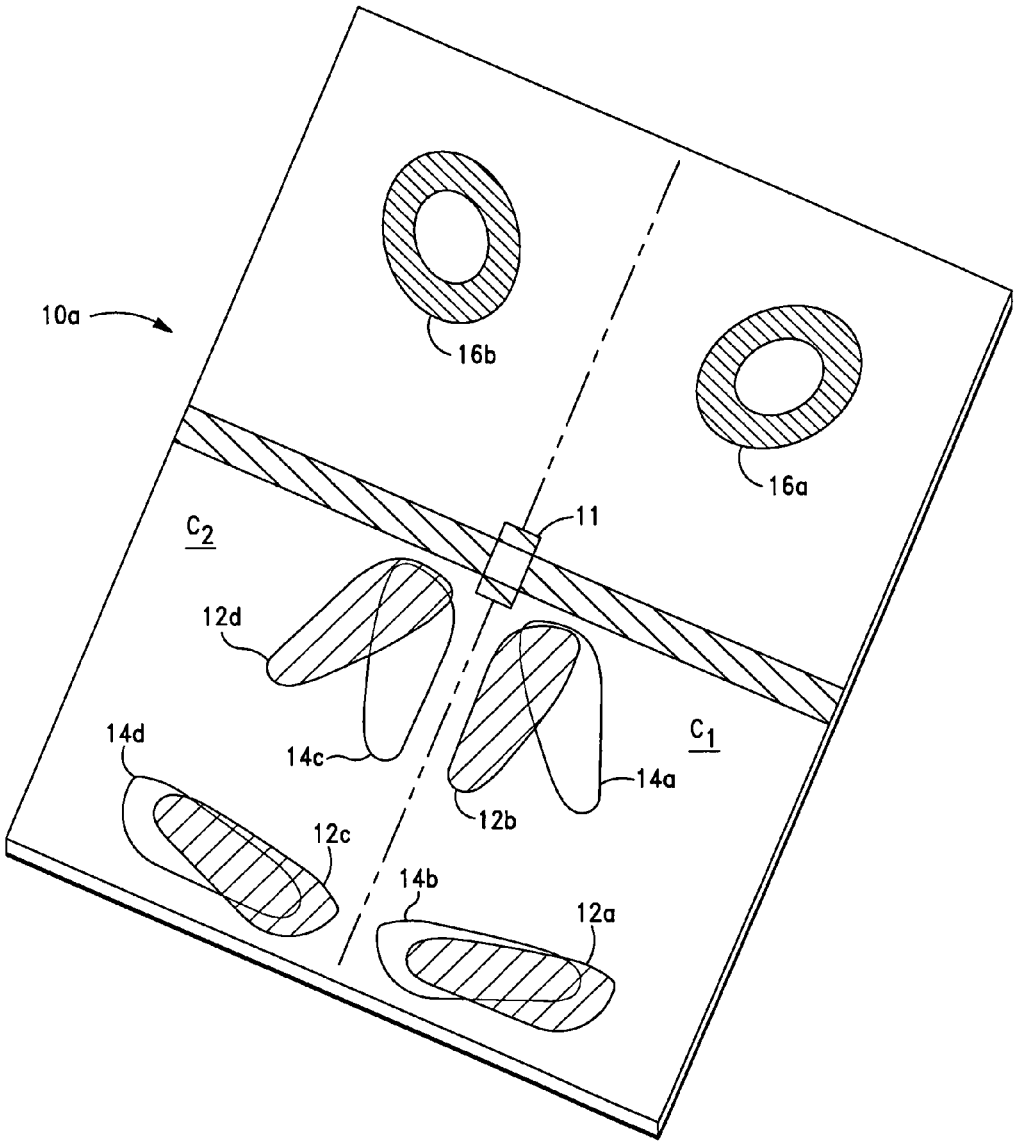
FIG. 1 is a perspective view of one embodiment of a foot placement platform, according to the invention.

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred apparatus, systems, structures and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms “a,” “an” and “the” include plural referents unless the content clearly dictates otherwise.

Novel features that are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are an illustration description only and are not intended as definitions of the limits of the invention.

Broad aspects of the present invention are set forth in the summary above. There are, of course, additional features of the invention that will be described hereinafter and which will form additional subject matter of the claims appended hereto.

Those skilled in the art will appreciate that the conception upon which this disclosure is based may readily be utilized as a basis for the designing other structures, methods and systems for carrying out the purposes of the present invention. The appended claims should thus be regarded as including such equivalent constructions insofar as they do not depart from the spirit and scope of the present invention.

As discussed in detail above, a tennis serve is a complicated action that is composed of several phases, and inter-related motions. The object or goal of the serve phases is to hit a tennis ball at a desired position and in a timely manner, whereby the ball is directed to a desired point on the court with the desired rotation or spin.

The static phase of the serve comprises positioning the body; particularly, the feet on the court prior to the service stroke. As stated, foot placement and movement are key aspects of an effective and consistent serve and are typically varied depending on the type of tennis serve being performed, e.g., topspin, slice, etc.

The active phase of a tennis serve includes two critical actions: the ball toss or trajectory and stroke (or service swing).

As set forth above, the present invention provides tennis training devices, systems and methods for developing proper foot placement, ball toss trajectory and stroke mechanics for performing an effective tennis serve. As will readily be appreciated by one having ordinary skill in the art, the tennis training devices can be employed separately or jointly to develop proper foot placement, ball toss trajectory and/or stroke mechanics.

Figure 2:
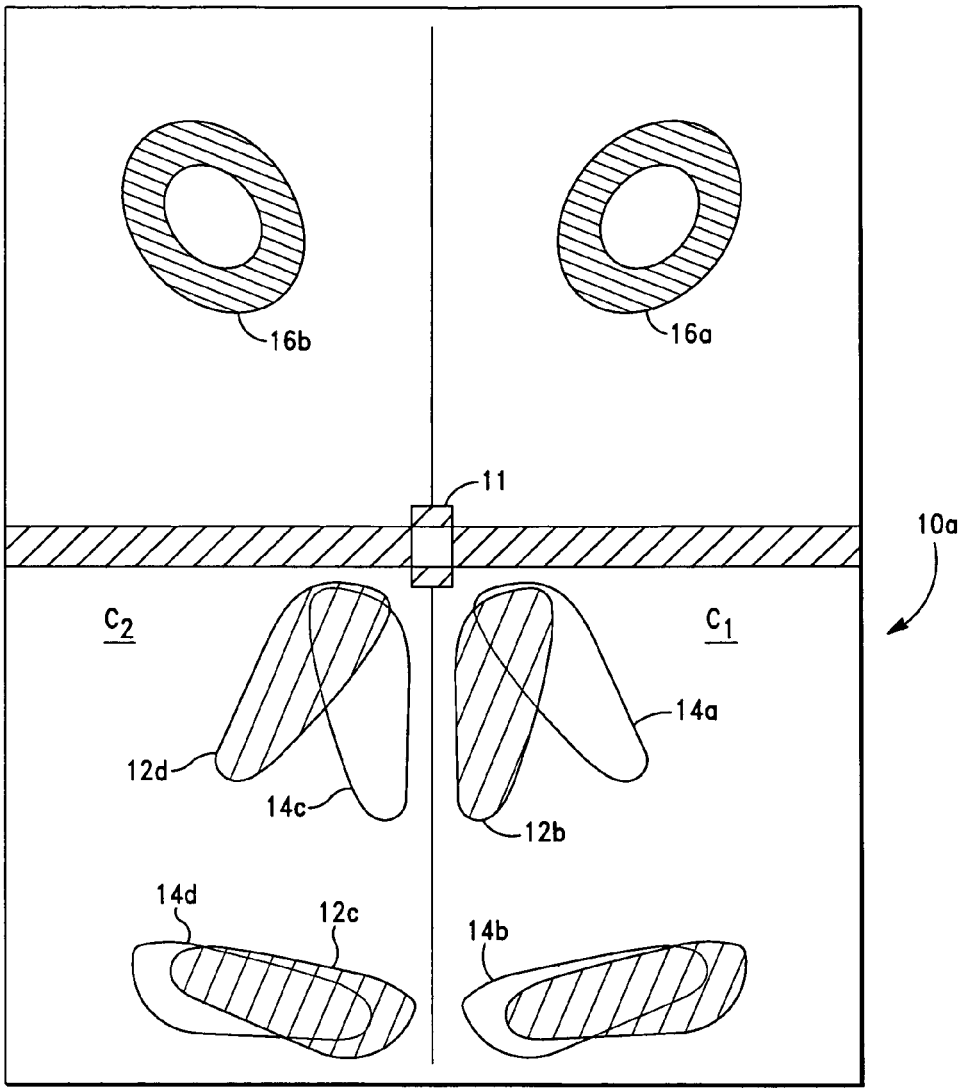
FIG. 2 is a top plan view of the foot placement platform shown in FIG. 1, according to the invention.

Referring now to FIGS. 1 and 2, there is shown one embodiment of a foot placement platform of the invention 10*a* that is designed and adapted to develop proper foot placement for performing an effective tennis serve.

As illustrated in FIG. 1, the platform 10*a* includes foot placement graphics indicating a standard (or desired) foot placement, i.e. stance, for the right and left foot 12*a*, 12*b*, respectively, for a right-handed player or server, and the right and left foot 14*a*, 14*b*, respectively, for a left-handed player or server serving from a first court area $C_1$ proximate the center mark 11 (or line), and the foot placement stance, for the right and left foot 12*c*, 12*d*, respectively, for a right-handed player or server, and the right and left foot 14*c*, 14*d*, respectively, for a left-handed player or server serving from a second court area $C_2$ proximate the center mark 11. The graphics also indicate the toss targets, i.e. forward foot post-stroke placement targets, 16*a*, 16*b*, for right-handed (16*a*) and left-handed (16*b*) players.

According to the invention, the standard foot graphics illustrated in FIGS. 1 and 2 (and FIGS. 4-7, discussed below), can comprise standard (or desired) foot placements for various sized adult and youth players.

In some embodiments of the invention, the foot graphics comprise tailored foot placements. In these embodiments, a player or tennis coach can provide the desired right and left foot coordinates or foot placements for the stance position and post-stoke forward foot placement for an individual player, which can be employed to place the foot graphics on a platform.

According to the invention, the platform 10*a* (and platform 10*b*, discussed below) can comprise various materials, including polyvinyl chloride (PVC), natural rubber, polymeric and rubber composites, and thermoplastic elastomers. In one embodiment of the invention, the platform 10*a* comprises polyvinyl chloride (PVC).

In some embodiments of the invention, the platform 10*a* (and platform 10*b*) has a thickness less than 1 in. In some embodiments of the invention, the platform 10*a* has a thickness in the range of approximately 0.25-1 in.

Figure 3:
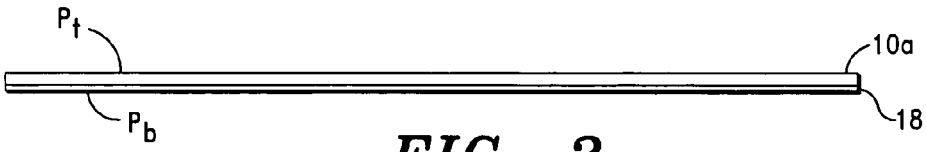
FIG. 3 is a front plan view of the foot placement platform shown in FIG. 1, according to the invention.

As illustrated in FIG. 3, in some embodiments of the invention, the platform 10*a* (and platform 10*b*) further includes an anti-skid or a non-slip backing 18 on the bottom side or surface $P_b$ that is opposite the side with the graphics (denoted "$p_t$"). According to the invention, various conventional anti-skid backings (or products) can be employed within the scope of the invention, including PEV™, Tread-Grip™, Sand-Tac™, Volextra™, and EZ Grip™.

Figure 4:
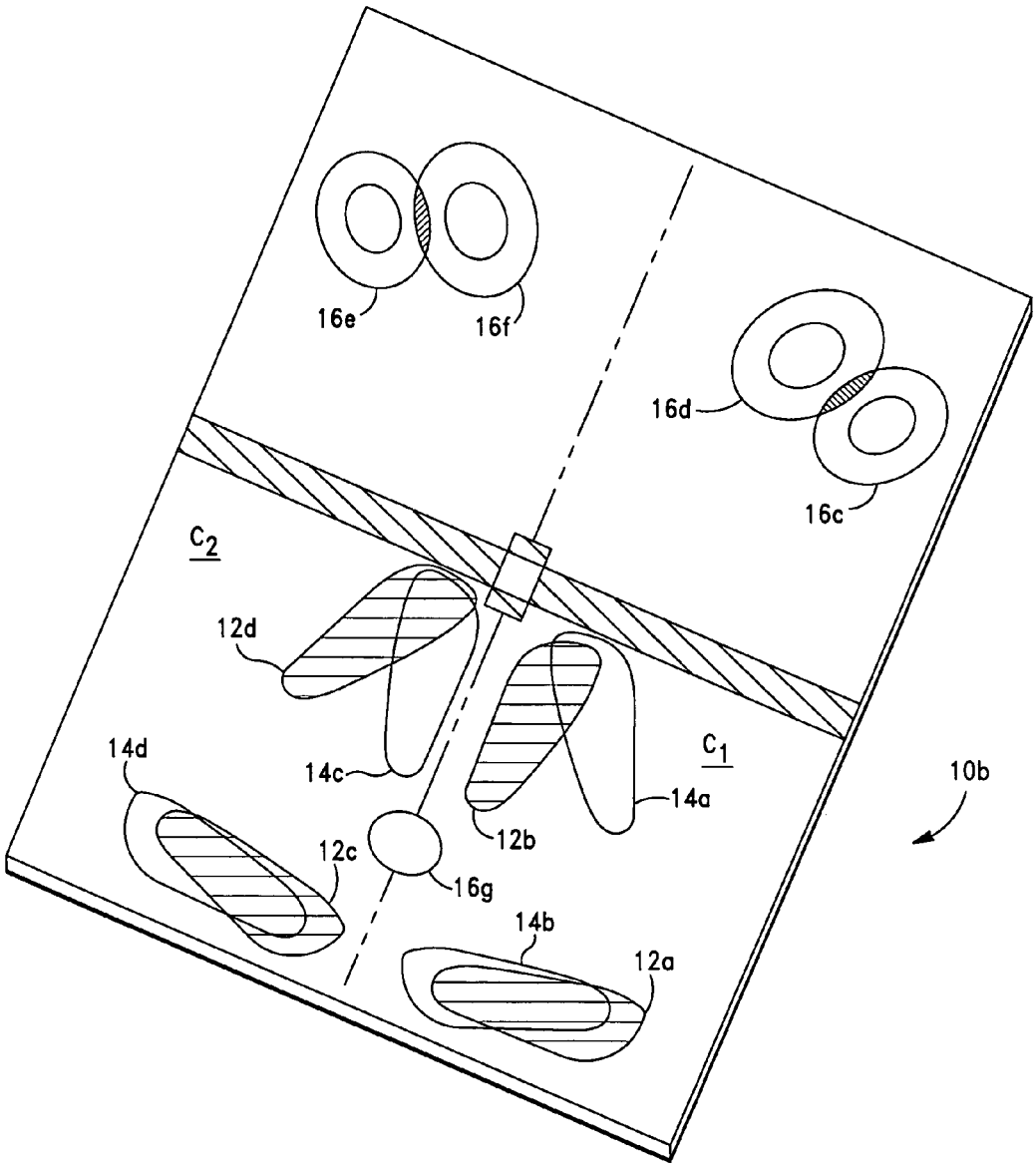
FIG. 4 is a perspective view of another embodiment of a foot placement platform, according to the invention.
Figure 5:
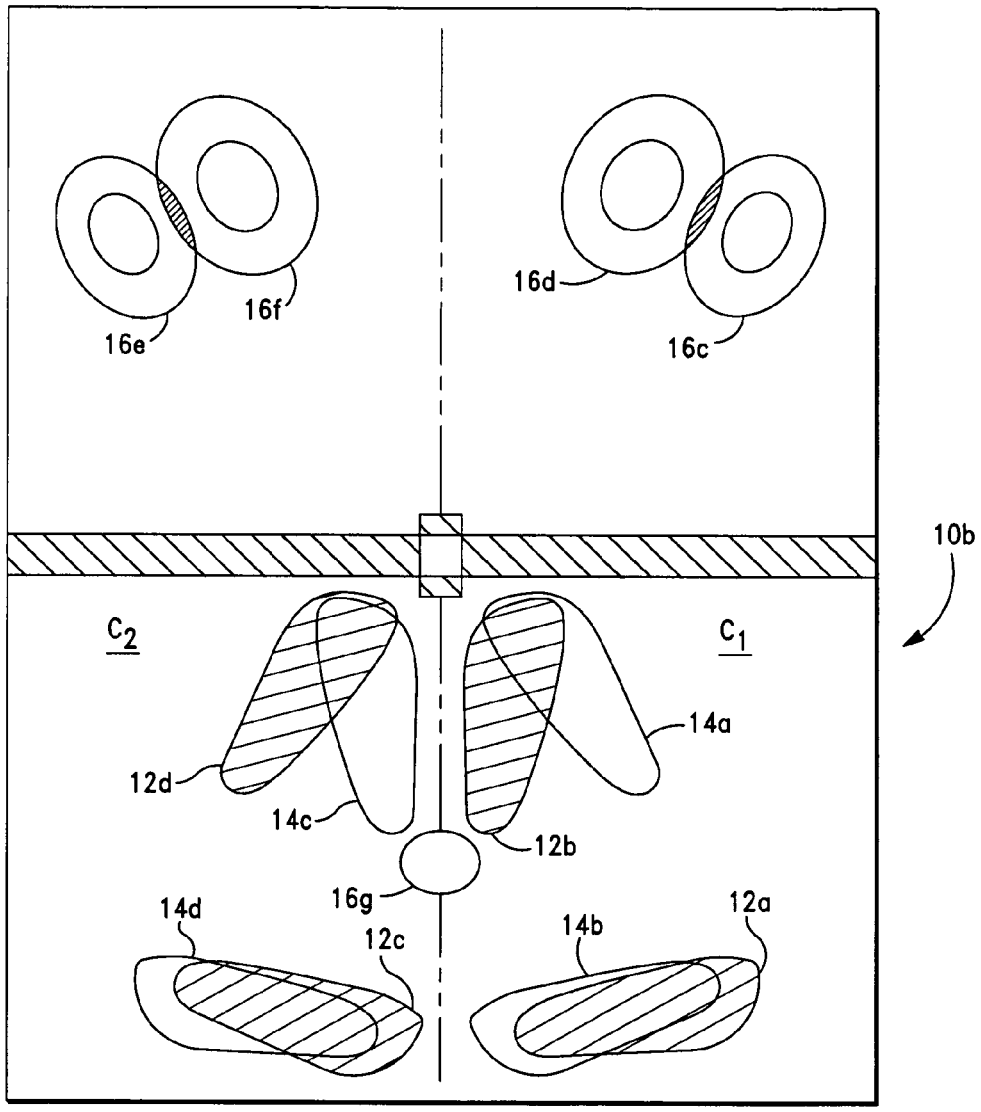
FIG. 5 is a top plan view of the foot placement platform shown in FIG. 4, according to the invention.

Referring now to FIGS. 4 and 5 there is shown another embodiment of a foot placement platform of the invention. As illustrated in FIG. 4, the platform 10*b* similarly includes foot placement graphics indicating a standard (or desired) foot placement stance for the right and left foot 12*a*, 12*b*, respectively, for a right-handed player or server, and the right and left foot 14*a*, 14*b*, respectively, for a left-handed player or server serving from a first court area $C_1$ proximate the center mark 11 (or line), and the foot placement stance, for the right and left foot 12*c*, 12*d*, respectively, for a right-handed player or server, and the right and left foot 14*c*, 14*d*, respectively, for a left-handed player or server serving from a second court area $C_2$ proximate the center mark 11.

In this embodiment, however, the graphics include forward foot post-stroke placement targets for a right-handed player performing slice and flat serves, (denoted 16*c* and 16*d*, respectively), forward foot post-stroke placement targets for a left-handed player performing slice and flat serves, (denoted 16*e* and 16*f*, respectively), and a forward foot post-stroke placement target for left-handed and right-handed players performing a kick serve (denoted 16*g*).

Figure 6:
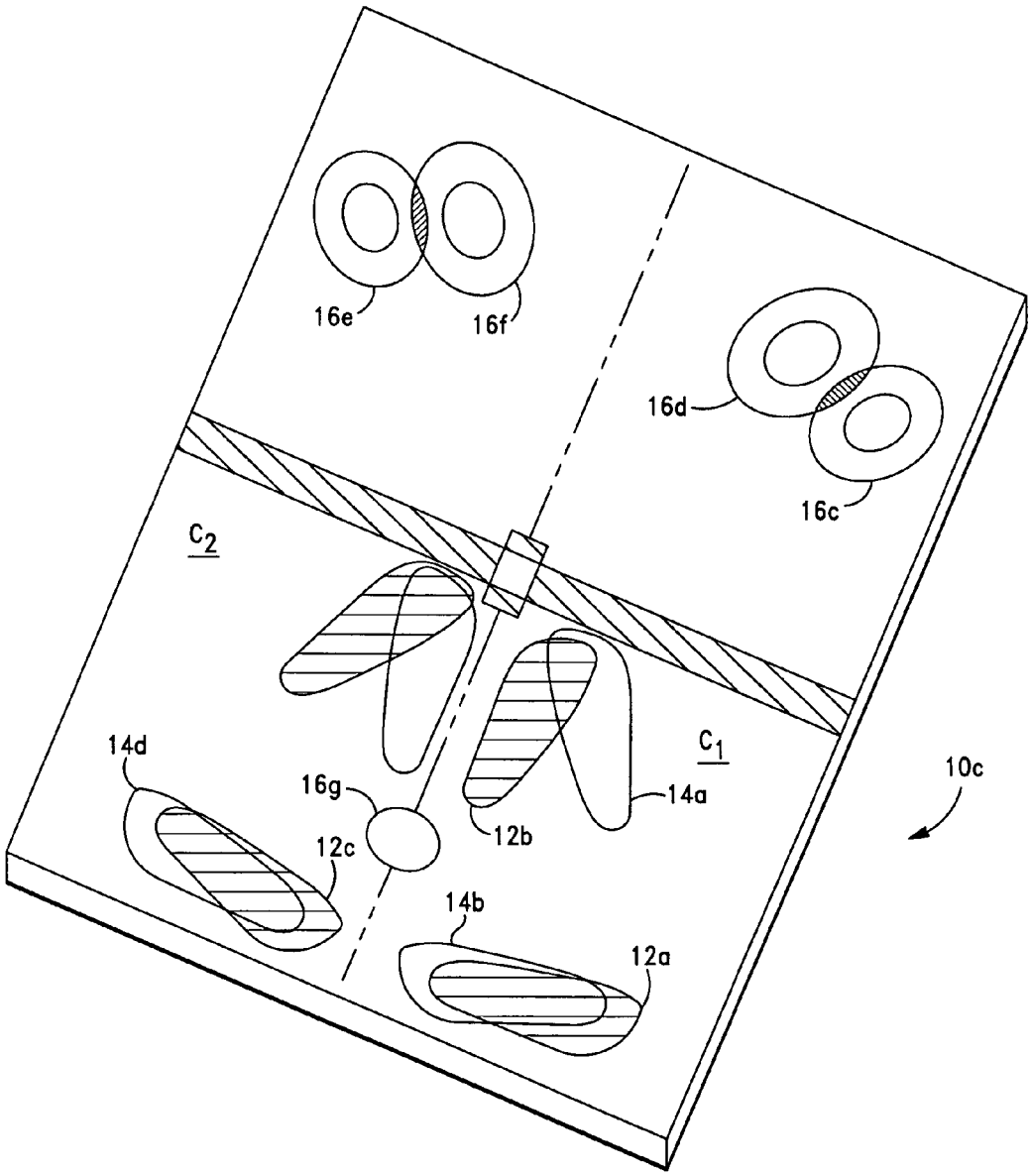
FIGS. 6 and 7 are perspective views of further embodiments of foot placement platforms, according to the invention.

To develop and/or enhance the stability of a player's feet and related musculature, in some embodiments of the invention, the foot placement platforms of the invention are constructed of a thicker compliant (or pliable) material (see, for example platform 10*c* shown in FIG. 6). According to the invention, the compliant material can comprise various conventional compliant materials, such as closed cell EVA, polyethylene and polyurethane foams. The compliant material can also have various thicknesses and/or densities to provide the desired degree of compliancy, i.e. give.

In one embodiment of the invention, the compliant material comprises closed cell EVA foam, having a thickness in the range of approximately 2-4 in.

Figure 7:
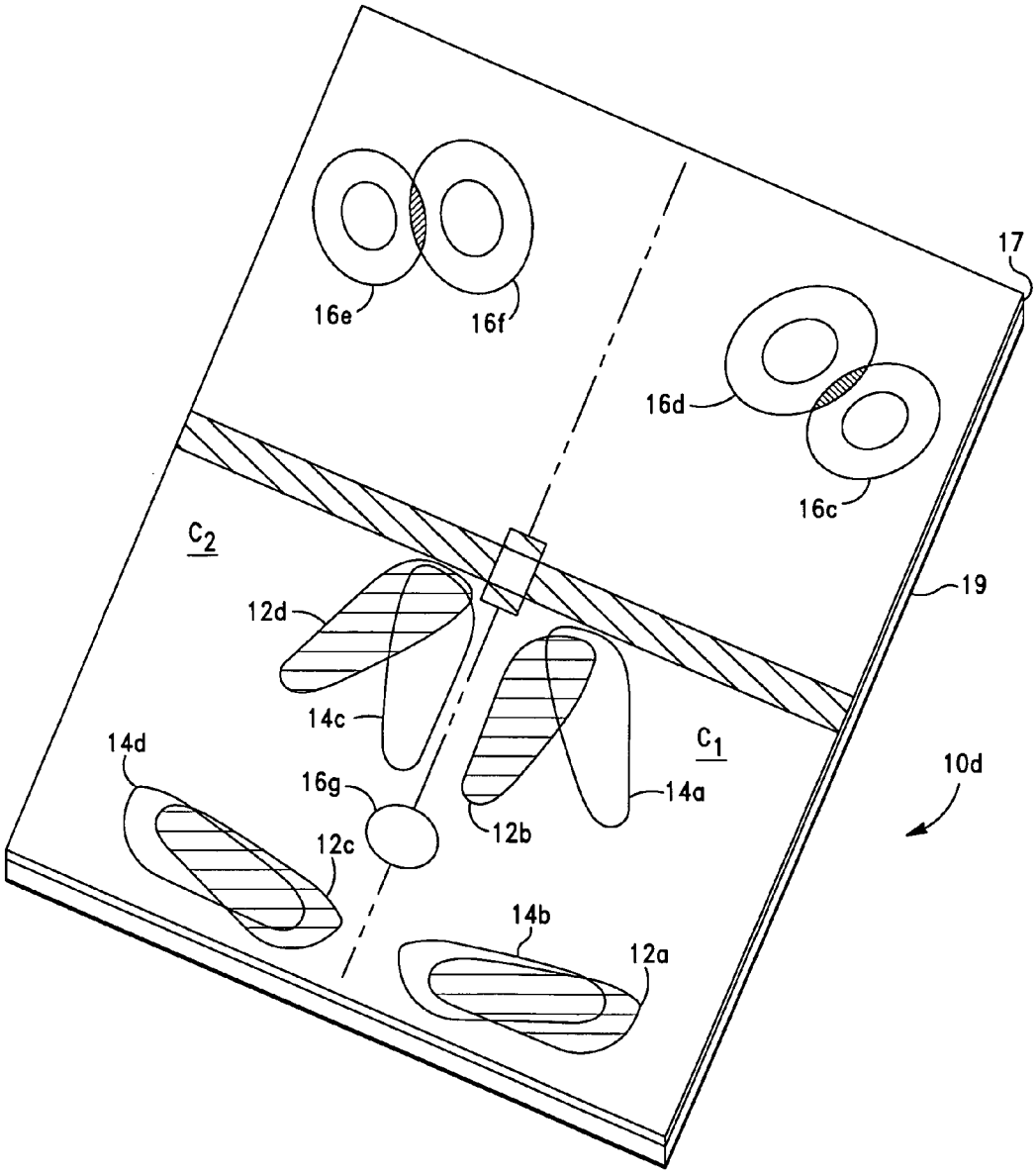

According to the invention, the foot placement platforms of the invention can also comprise multiple component structures. Referring now to FIG. 7, there is shown one embodiment of a multiple component platform 10*d*. As illustrated in FIG. 7, the platform 10*d* includes a top material or sheet 17 with the foot graphics disposed thereon and a compliant second material 19 disposed or attached to the bottom surface of the top material.

According to the invention, the foot placement platforms of the invention, including platforms 10*a*, 10*b*, 10*c* and 10*d*, discussed above, can also be employed with the stroke training devices described in Applicant's Co-Pending application Ser. Nos. 12/731,987 and 13/065,623, which are expressly incorporated by reference herein in their entirety.

Figure 8:
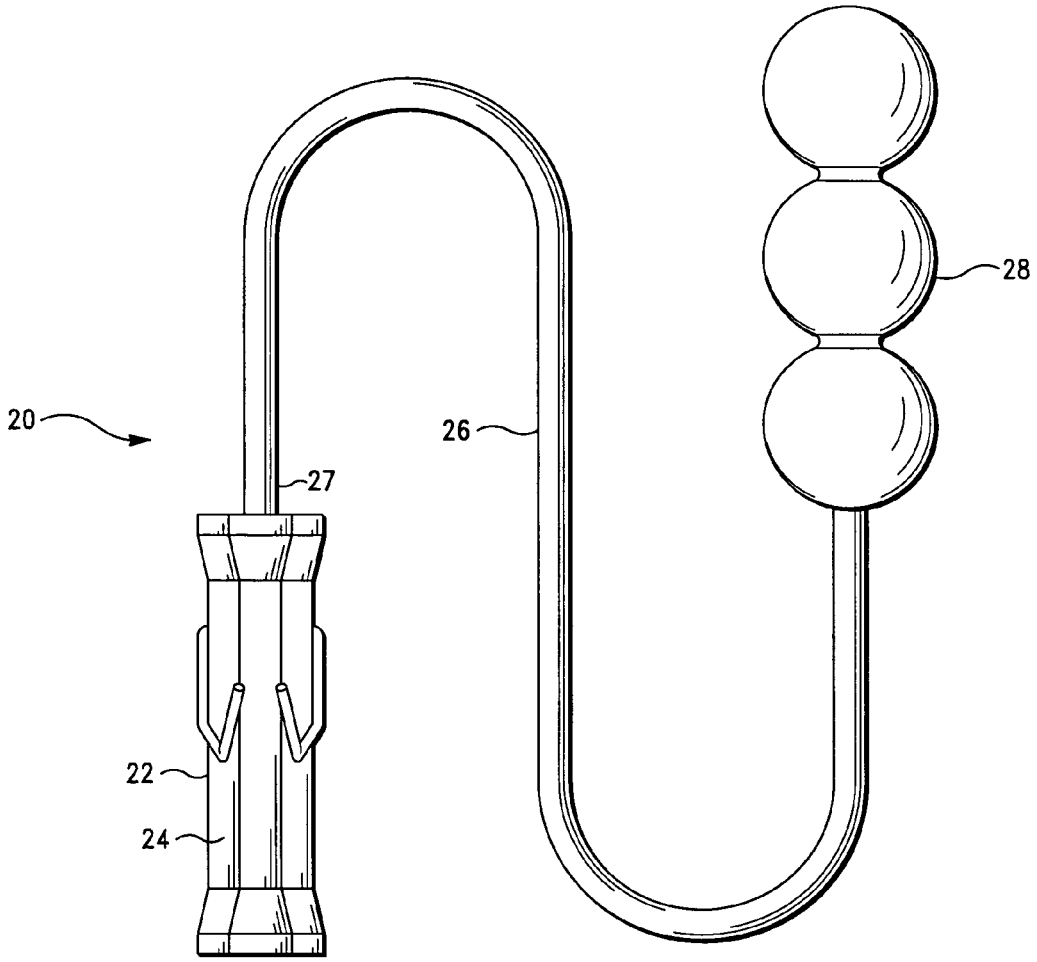
FIG. 8 is a front plan view of one embodiment of a tennis stroke training device, according to the invention.

Referring now to FIG. 8, there is shown one embodiment of the stroke training device 20. As illustrated in FIG. 8, the training device 20 is provided with grip 22 that emulates a tennis racquet grip and is sized for being held by a user, and a flexible umbilical 26.

The grip 22 preferably has an oval circumference with eight flat beveled surfaces 12, again, for emulating the feel of a standard tennis racquet grip. The grip 22 includes butt and distal ends; the butt end generally finished with expanded cap 25 (see FIG. 10).

As illustrated in FIG. 8, the flexible umbilical 26 includes a first end 27 attached to and emanating from the distal end of the grip 22. A device weight 28 is attached to the second end of the umbilical 26.

Although the training device 20 of the present invention, as depicted in FIG. 8, shows umbilical 26 bent in a serpentine fashion, when straightened, the total length of the device 20 is ideally sized to emulate the length of an average tennis racquet, i.e. approximately 26" to 28". The umbilical 26 is not only flexible, but is capable of stretching approximately 1" from a first rest position (or length) as weight 28 pulls upon umbilical 26 during use.

Although weight 28 is shown as three consecutively aligned weighted balls attached to umbilical 26, according to the invention, a single weighted orb or a plethora of such can also be employed while remaining within the spirit and scope of the present invention.

The weighted end of the device 20 can comprise various weights, e.g., 13-15 oz. In some embodiments, the weight 28 has a cumulative weight of approximately 8 oz.

Figure 9:
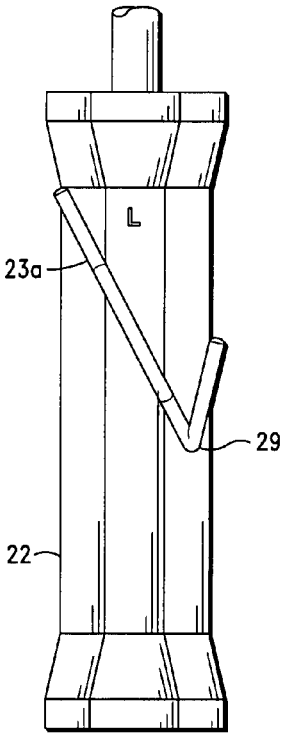
FIG. 9 is a left side plan view of the device grip shown in FIG. 8, in accordance with one embodiment of the invention.
Figure 10:
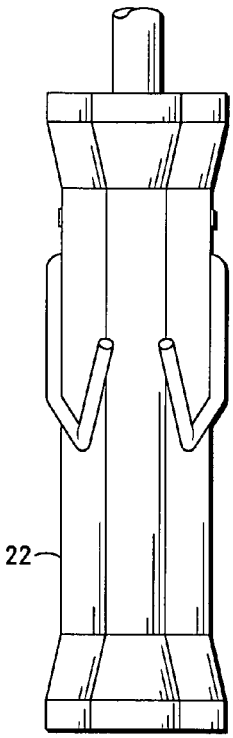
FIG. 10 is a front plan view of the device grip shown in FIG. 8, in accordance with one embodiment of the invention.
Figure 11:
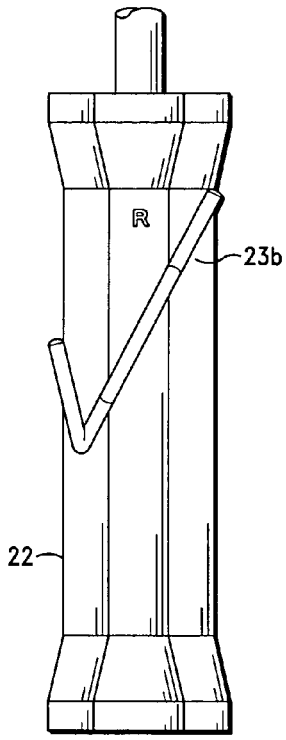
FIG. 11 is a right side plan view of the device grip shown in FIG. 8, in accordance with one embodiment of the invention.
Figure 12:
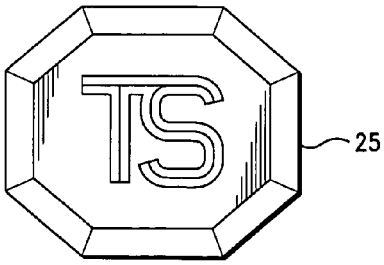
FIG. 12 is a bottom plan view of the device grip shown in FIG. 8, in accordance with one embodiment of the invention.

Referring now to FIGS. 9-12, details of the device grip 22 are shown. FIG. 10 shows the back side of grip 22, while FIGS. 9 and 11 show opposite sides of the grip 22 in order to provide the appropriate illustration of raised markers 23*a* and 23*b*. Raised marker 23*a*, which is shown in FIG. 9, is intended to create a V or U-shaped series of segments establishing notch 29. According to the invention, when grip 22 is appropriately held by a user, notch 29 would nest in that portion of the user's hand between one's thumb and index finger.

Raised marker 23*a* is intended to be used by a left handed player and its use is indicated by the letter "L". Conversely, grip 22 can also be used by a right handed player by employing raised marker 23*b*. Use of this marker is indicated by the letter "R".

To complete the device 20, butt end of the grip includes expanded or butt cap 25 to prevent the grip 22 from slipping out of a user's hand.

The stroke training device, which is commercially available through The Total Serve (Oakland, Calif.), will encourage a user to properly perform a service stroke, i.e. with the user's arm fully extended upward, when properly employed. Failure to do so will prevent umbilical 26 from remaining taut throughout the motion resulting in an uncontrolled movement of weight 28. This provides a clear indication to a user that the stroke has not been carried out properly.

According to the invention, the foot placement platforms of the invention, including platforms 10*a*, 10*b*, 10*c* and 10*d*, and stroke training devices described in Applicant's Co-Pending application Ser. Nos. 12/731,987 and 13/065,623, including device 20 described above, can also be employed with the ball toss training devices of the invention.

Figure 13:
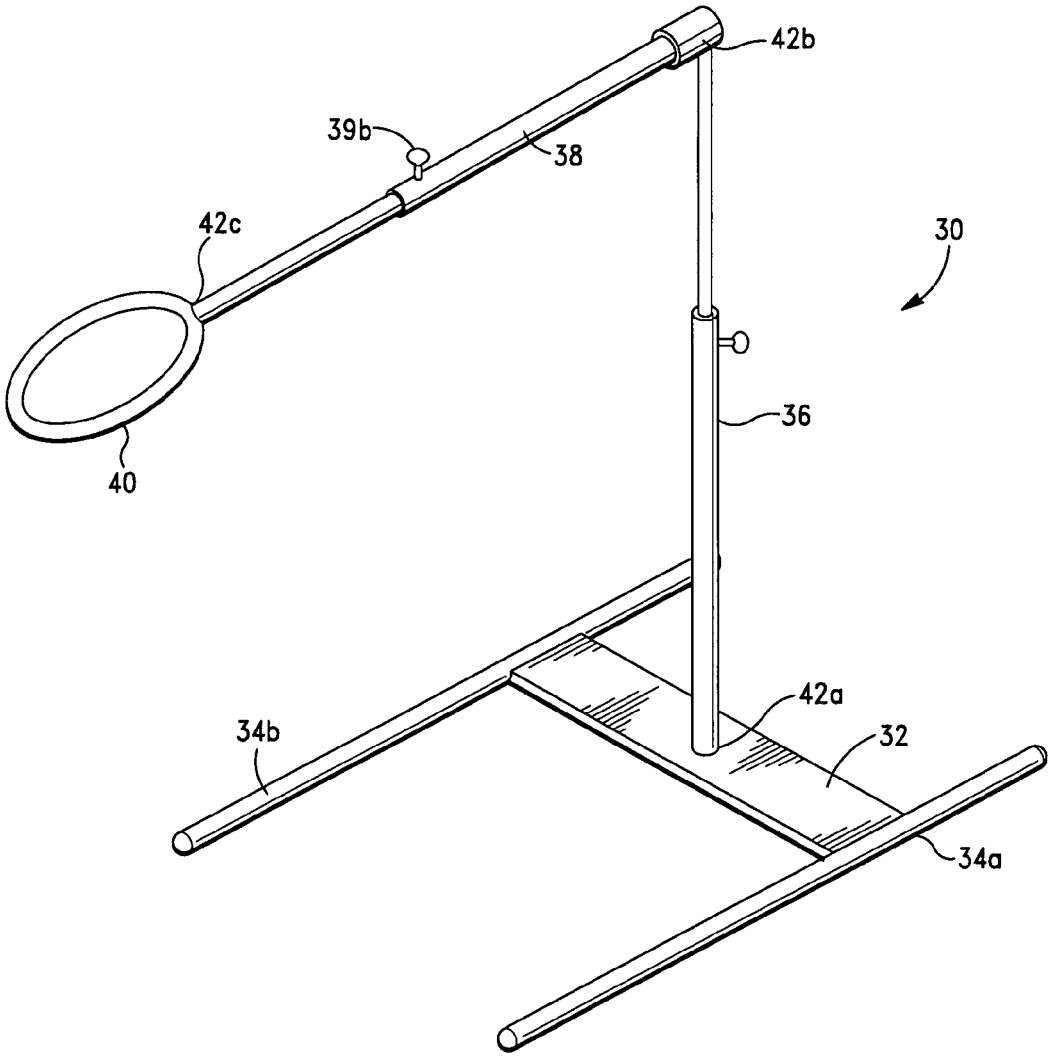
FIG. 13 is a perspective view of one embodiment of a ball toss training device, according to the invention.
Figure 14:
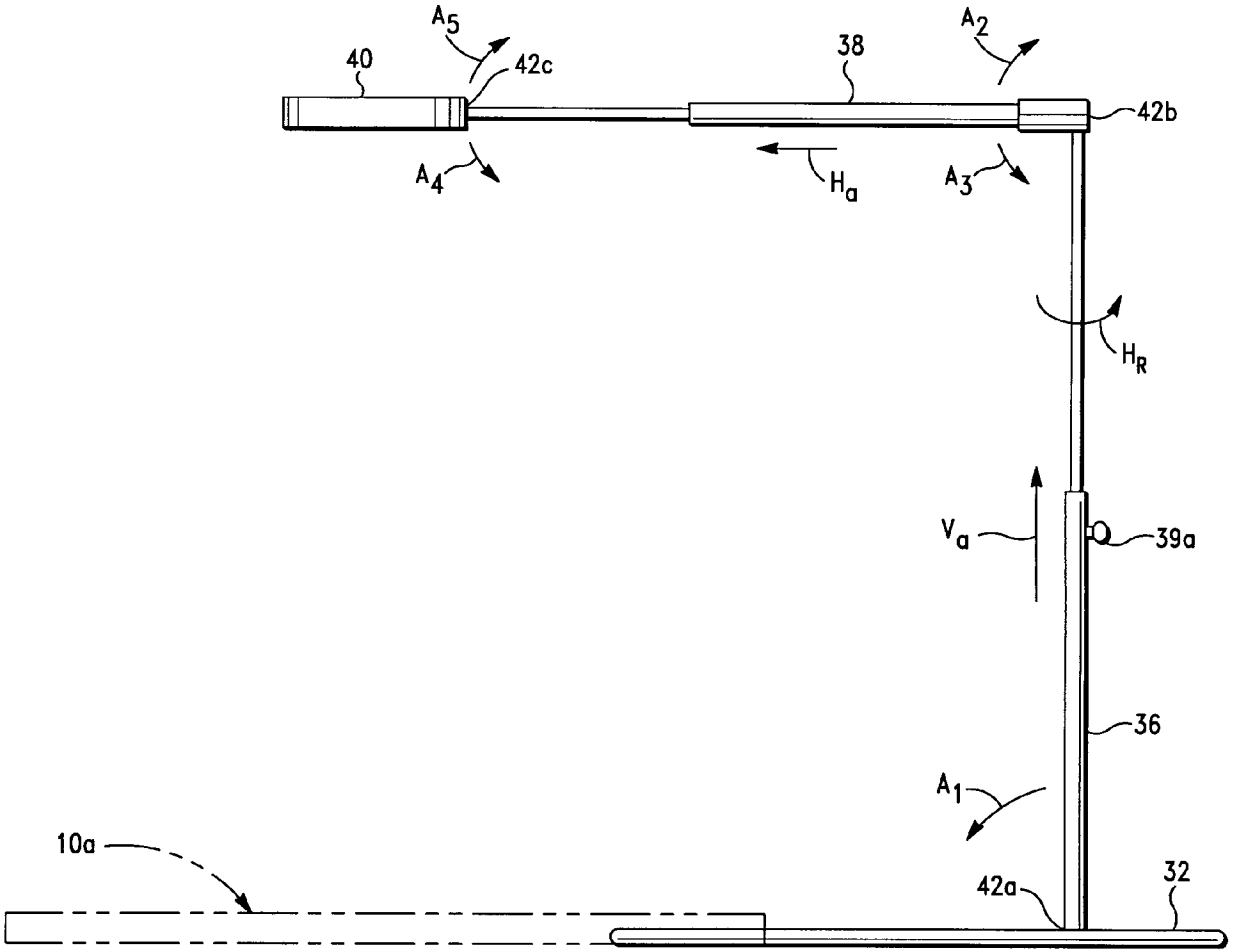
FIG. 14 is a side plan view of the ball toss training device shown in FIG. 13, in accordance with one embodiment of the invention.

Referring now to FIGS. 13 and 14, there is shown one embodiment of a ball toss training device of the invention (denoted 30). As illustrated in FIG. 13, the ball toss training device 30 includes a base 32 with two legs 34*a*, 34*b*, a telescopic vertical support 36 that is attached to the base 32, a telescopic horizontal support 38 that is operatively connected to the vertical support 36, and a target hoop 40.

According to the invention, the telescopic vertical and horizontal supports 36, 38 facilitate adjustment in their respective planes, as shown by Arrows $V_a$ and $H_a$. The telescopic vertical support 36 also allows rotation of the horizontal support 38 about the longitudinal axis of the vertical support 36, as shown by Arrow $H_r$. To secure the vertical and horizontal supports 36, 38 in desired positions, conventional locking means, such as the set screws 39*a*, 39*b* that are illustrated in FIG. 13, are provided.

In some embodiments of the invention, the ball toss training device 30 is collapsible. In these embodiments, conventional pivoting joints or assemblies are employed at the juncture of the base 32 and vertical support 36 (denoted "42*a*"), the juncture of the vertical 36 and horizontal 38 support (denoted "42*b*"), and the juncture of the horizontal support 38 and hoop 40 (denoted "42*c*") to facilitate rotating or folding the vertical 36 and horizontal 38 supports, and hoop 40 in the directions denoted by Arrows $A_1$-$A_5$. In these embodiments, the pivoting joints are also adapted to disengageably secure the vertical 36 and horizontal 38 supports in a desired angular relationship to each other, e.g., substantially perpendicular relationships.

As will readily be appreciated by one having ordinary skill in the art, the tennis serve training system, referred to as The Total Serve™ system, when properly employed, provides an effective means for developing the key aspects of a serve—foot placement, ball toss or trajectory and service stroke—separately or jointly.

The above disclosure is sufficient to enable one having ordinary skill in the art to practice the invention, and provides the best mode of practicing the invention presently contemplated by the inventor. While there is provided herein a full and complete disclosure of the preferred embodiments of the invention, it is not intended or desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features of the like.

Therefore, the above description and illustration should not be considered as limiting the scope of the invention, which is identified by the appended claims.

What is claimed is:

1. A tennis skill training system, the system consisting of:

a foot placement platform and stroke training device, said foot placement platform consisting of a substantially planar member having a top and bottom surface, said top surface of said member including foot placement graphics disposed thereon, said foot placement graphics consisting of a first stance position representing right and left foot positions for a right-handed player proximate a first court area, a second stance position representing right and left foot positions for said right-handed player proximate a second court area, a third stance position representing right and left foot positions for a left-handed player proximate said first court area, a fourth stance position representing right and left foot positions for a left-handed player proximate said second court area, a first toss target representing a first forward foot post-stroke position for said right-handed player, and a second toss target representing a second forward foot post-stroke position for said left-handed player, said stroke training device consisting of a grip emulating a tennis racket grip, said grip being sized for being held by a user when employing said device for training, a single flexible and extendable umbilical having first and second ends, said first end being attached to and emanating from said grip, said umbilical being capable of stretching and extending along its axis approximately 1 in from an initial unstretched length, and a first fixed weight attachable to said second end of said umbilical, said first weight having a weight in the range of approximately 13-15 oz, whereby when said first fixed weight is attached to said umbilical and said device is subjected to rotational motion in a vertical plane by a user's arm said device generates a first angular momentum, whereby said umbilical stretches from first at-rest length to a second extended length, and whereby said device exerts an outwardly directed first force on said user's arm that tends to extend said user's arm.

2. The system of claim 1, wherein said grip includes a raised marker on said grip circumference that indicates proper hand placement during use of said device.

3. The system of claim 2, wherein said grip includes two raised markers, said raised markers comprising a first marker for left handed users and a second marker for right handed users.

4. A method of determining stroke mechanics of a right-handed tennis player, said player having right and left arms, left and right hands, and left and right feet, said method comprising the steps of:

providing a tennis training system having a foot placement platform and stroke training device, said foot placement platform comprising a substantially planar member having a top and bottom surface, said top surface of said member including foot placement graphics disposed thereon, said foot placement graphics comprising a first stance position representing the right and left foot positions for a right-handed player proximate a first court area, and a first toss target representing a first forward foot post-stroke position for said right-handed player, said stroke training device comprising a grip emulating a tennis racket grip, said grip being sized for being held by a user when employing said device for training, a single flexible and extendable umbilical having first and second ends, said first end being attached to and emanating from said grip, said umbilical being capable of stretching and extending along its axis from an initial at-rest length to an extended length, and a first fixed weight attachable to said second end of said umbilical, said first weight having a weight in the range of 13-15 oz, whereby when said first fixed weight is attached to said umbilical and said device is subjected to rotational motion in a vertical plane by a user's arm said device generates a first angular momentum, whereby said umbilical stretches from said at-rest length to said extended length, and whereby said device exerts an outwardly directed first force on said user's arm that tends to extend said user's arm;

positioning said player's right and left feet proximate said first stance right and left foot positions on said foot placement platform, said left foot being placed forward of said right foot; and determining a first extended length of said umbilical when said player simultaneously moves said left foot from said first stance left foot position toward said first forward foot post-stroke position and performs a first overhead rotational motion in a first vertical plane with said player's right arm while grasping said umbilical in said subject's right hand;

re-positioning said player's right and left feet proximate said first stance right and left foot positions on said foot placement platform, said left foot being placed forward of said right foot;

determining a second extended length of said umbilical when said player simultaneously moves said left foot from said first stance left foot position toward said first forward foot post-stroke position and performs a second overhead rotational motion in said first vertical plane with said player's right arm while grasping said umbilical in said subject's right hand;

determining said player's stroke mechanics by comparing said first and second extended lengths, wherein, when said second extended length of said umbilical is greater than said first extended length, said player's stroke mechanics represents controlled movement of said umbilical.

5. A method of determining stroke mechanics of a left-handed tennis player, said player having right and left arms, left and right hands, and left and right feet, said method comprising the steps of:

providing a tennis training system having a foot placement platform and stroke training device, said foot placement platform comprising a substantially planar member having a top and bottom surface, said top surface of said member including foot placement graphics disposed thereon, said foot placement graphics comprising a first stance position representing right and left foot positions for a left-handed player proximate a first court area, and a first toss target representing a first forward foot post-stroke position for said left-handed player, said stroke training device comprising a grip emulating a tennis racket grip, said grip being sized for being held by a user when employing said device for training, a single flexible and extendable umbilical having first and second ends, said first end being attached to and emanating from said grip, said umbilical being capable of stretching and extending along its axis from an initial at-rest length to an extended length, and a first fixed weight attachable to said second end of said umbilical, said first weight having a weight in the range of 13-15 oz, whereby when said first fixed weight is attached to said umbilical and said device is subjected to rotational motion in a vertical plane by a user's arm said device generates a first angular momentum, whereby said umbilical stretches from said at-rest length to said extended length, and whereby said device exerts an outwardly directed first force on said user's arm that tends to extend said user's arm;

positioning said player's right and left feet proximate said first stance right and left foot positions on said foot placement platform, said right foot being placed forward of said left foot; and determining a first extended length of said umbilical when said player simultaneously moves said player's right foot from said first stance right foot position toward said first forward foot post-stroke position and performs a first overhead rotational motion in a first vertical plane with said player's left arm while grasping said umbilical in said subject's left hand;

re-positioning said player's right and left feet proximate said first stance right and left foot positions on said foot placement platform, said right foot being placed forward of said left foot;

determining a second extended length of said umbilical when said player simultaneously moves said right foot from said first stance right foot position toward said first forward foot post-stroke position and performs a second overhead rotational motion in said first vertical plane with said player's left arm while grasping said umbilical in said subject's left hand;

determining said player's stroke mechanics by comparing said first and second extended lengths, wherein, when said second extended length of said umbilical is greater than said first extended length, said player's stroke mechanics represents controlled movement of said umbilical.

* * * * *